US006056774A

United States Patent [19]

Johansen et al.

[11] Patent Number: 6,056,774

[45] Date of Patent: May 2, 2000

[54] TWO-PART TEETHABLE HANDLE FOR INFANT PACIFIERS

[75] Inventors: Jean L. Johansen, Reedsburg; Gerald A. Thoe, Chippewa Falls; Brenda J. Meyers, Reedsburg, all of Wis.

[73] Assignee: Gerber Products Company, Fremont, Mich.

[21] Appl. No.: 09/266,347

[22] Filed: Mar. 11, 1999

[51] Int. Cl.[7] ..... A61J 17/00

[52] U.S. Cl. ..... 606/234

[58] Field of Search ..... 606/234, 235; 115/110, 114, 115; D24/194, 195, 196

[56] References Cited

U.S. PATENT DOCUMENTS

| | | | |
|---|---|---|---|
| D. 150,114 | 7/1948 | Davis . | |
| 652,034 | 6/1900 | Meinecke . | |
| 1,070,430 | 8/1913 | Dunn . | |
| 1,518,823 | 12/1924 | Schmidt et al. . | |
| 2,085,704 | 6/1937 | Sacks . | |
| 2,825,335 | 3/1958 | Natonek . | |
| 3,267,937 | 8/1966 | Verschoor . | |
| 3,669,117 | 6/1972 | Herbst | 606/234 |
| 5,078,732 | 1/1992 | Ceniceros | 606/235 |
| 5,160,344 | 11/1992 | Werton . | |
| 5,653,731 | 8/1997 | Rohrig | 606/234 |

*Primary Examiner*—Michael Buiz
*Assistant Examiner*—Kevin Truong
*Attorney, Agent, or Firm*—Price, Heneveld, Cooper, DeWitt & Litton

[57] ABSTRACT

A pacifier for infants and the like includes a two-part teethable handle construction having a rigid inner handle member and a soft outer handle member. The rigid inner handle member is connected with the pacifier and has an outer surface shaped for grasping. The soft outer handle member overlies at least a portion of the outer surface of the rigid inner handle member and is securely connected therewith to define a chewable portion of the handle construction adapted for teething.

29 Claims, 4 Drawing Sheets

TWO-PART TEETHABLE HANDLE FOR INFANT PACIFIERS

BACKGROUND OF THE INVENTION

The present invention relates to infant pacifiers and the like, and in particular to a pacifier having an over-molded, soft, teethable outer covering.

Devices for aiding infants in the teething process are common in the art. These devices are typically pliable and allow for deformation when the infant bites down onto the device, thus urging the infant's teeth through the gum without inflicting pain on the infant. These devices may be adapted for attachment with a nipple or similar apparatus functional for sucking by the infant thereby calming the infant between feedings and/or satisfying his or her urge to suck.

Heretofore, these devices have typically not taken full advantage of modern manufacturing processes and materials. Prior devices typically comprise a single material that is either too stiff for teething purposes or too soft such that the device is not sufficiently resilient to withstand the repeated deformation required.

SUMMARY OF THE INVENTION

One aspect of the present invention is to provide a pacifier for infants and the like, having a two-part teethable handle construction including a rigid handle member and a soft outer handle member. The rigid inner handle member is connected with the pacifier and has an outer surface shaped for grasping. The soft outer handle member overlies at least a portion of the outer surface of the rigid inner handle member and is securely connected therewith to define a chewable portion of the handle construction adapted for teething.

Another aspect of the present invention is to provide a method for making a pacifier for infants and the like including providing a nipple member shaped for reception in the mouth of a user, forming a rigid inner handle member with an outer surface thereof shaped for grasping, molding a soft outer handle member over at least a portion of the outer surface of the rigid inner handle member to securely connect the same therewith and define a two-part handle with a chewable portion adapted for teething, and connecting the two-part handle with the nipple member.

Yet another aspect of the present invention is to provide a pacifier for infants and the like including a nipple member and a two-part teethable handle. The nipple member is shaped for reception in the mouth of the user. The two-part teethable handle is connected with the nipple member and has a rigid inner handle member and a soft outer handle member. The rigid inner handle member has an outer surface shaped for grasping. The outer handle member overlies at least a portion of the outer surface of the rigid inner handle member and is securely connected therewith to define a chewable portion of the handle construction adapted for teething.

The principal objects of the present invention are to provide a two-part teethable handle for pacifiers which is quite convenient, especially for travel and the like, since it alleviates the need for a separate teether. The two-part handle includes a rigid inner handle member, with a soft outer handle member overlying the same for effective teething action, as well as an easy-to-grip handle. The teethable handle has an uncomplicated design that facilitates manufacture, and renders the pacifier easy to clean and sanitize.

These and other features, advantages and objects of the present invention will be further understood and appreciated by those skilled in the art by reference to the following specification, claims and appended drawings.

DETAILED DESCRIPTION OF PREFERRED EMBODIMENT

For the purposes of description herein, the terms "upper", "lower", "right", "left", "rear", "front", "vertical", "horizontal", and derivatives thereof shall relate to the invention as oriented in the mouth of a user in an upright sitting position. However, it is to be understood that the invention may assume various alternative orientations and step sequences, except where it is expressly specified to the contrary. It is also to be understood that the specific invention and the processes illustrated in the attached drawings, and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
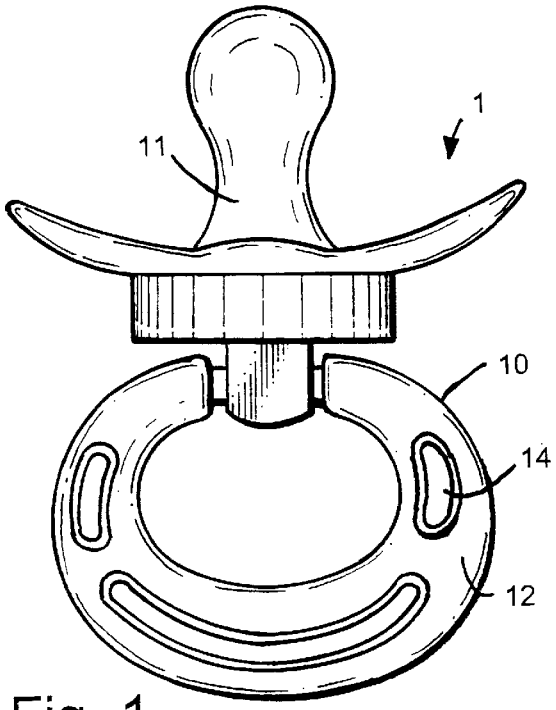
FIG. 1 is a bottom plan view of a pacifier embodying the present invention.

The reference numeral 1 (FIG. 1) generally designates an infant pacifier embodying the present invention. The pacifier 1 includes a handle 10 having a rigid inner handle member 12 and a soft outer handle member 14, and a pacifier portion 11 configured for insertion in the user's mouth. The inner handle member 12 is configured to connect with the pacifier portion 11 and is shaped for grasping by an infant. The outer handle member 14 overlies at least a portion of the inner handle member 12 and is securely connected therewith to define a chewable portion of the handle 10 adapted for teething.

Figure 2:
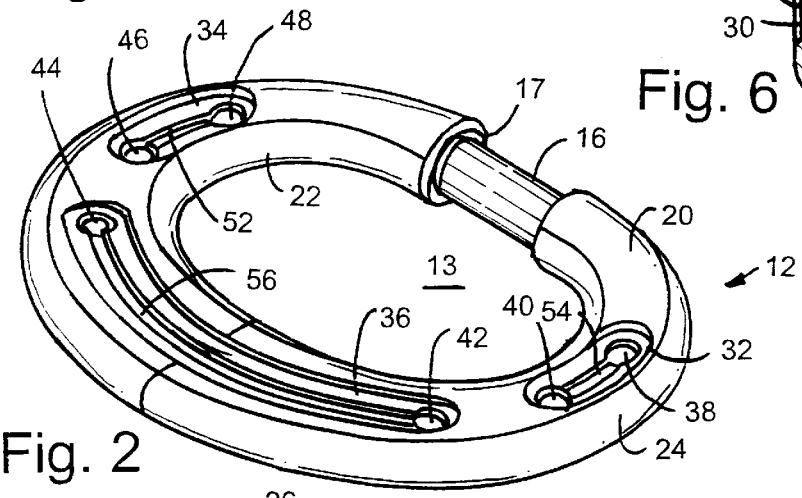
FIG. 2 is a top perspective view of a rigid inner handle member of the pacifier.
Figure 4:
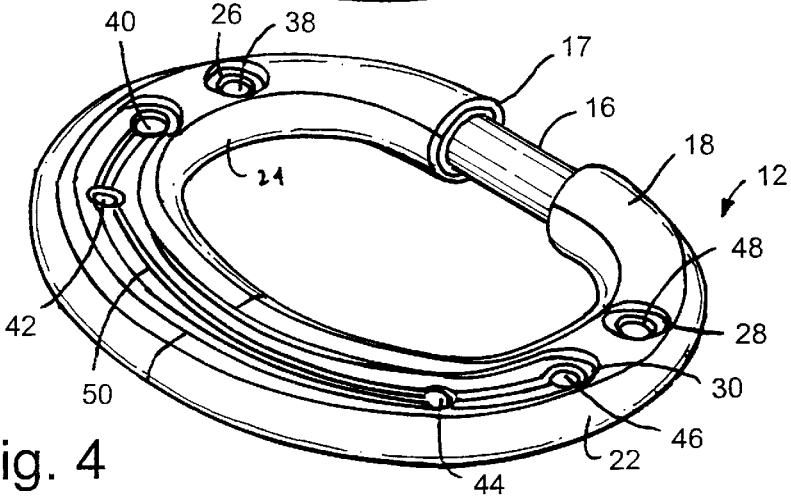
FIG. 4 is a bottom perspective view of the rigid inner handle member.
Figure 5:
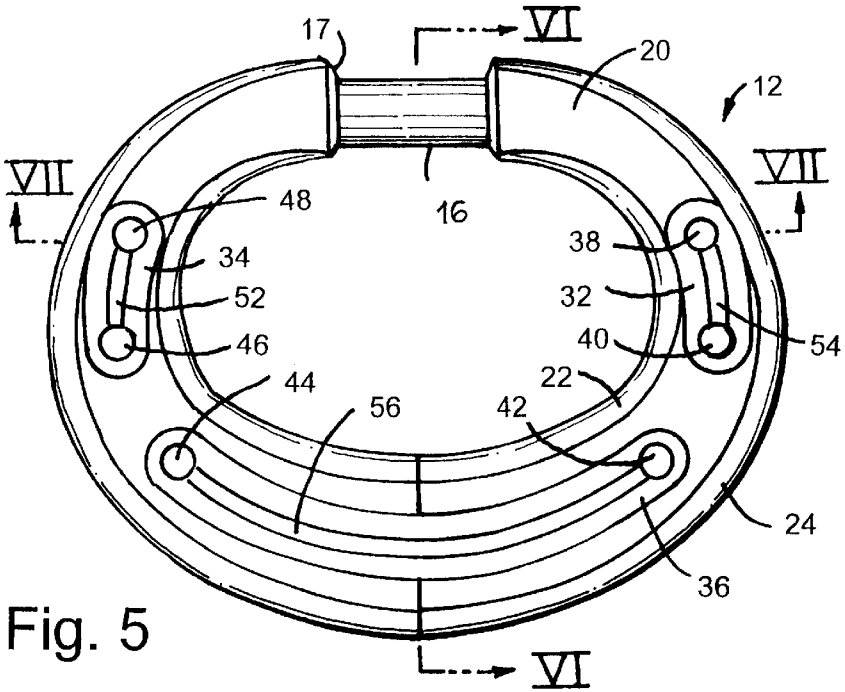
FIG. 5 is a bottom plan view of the rigid inner handle member.
Figure 8:
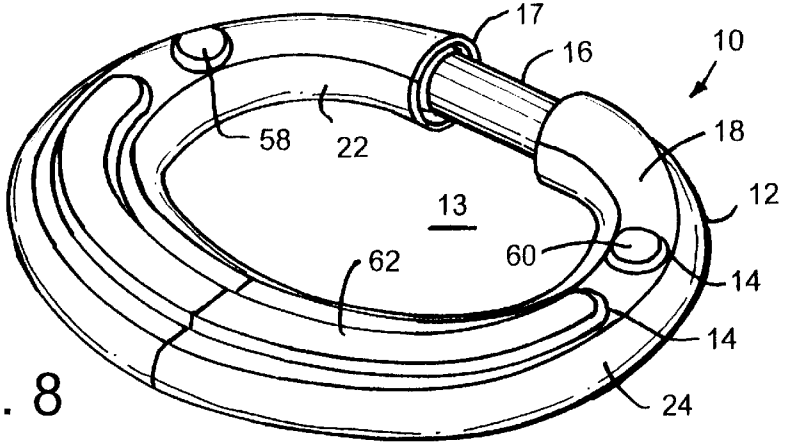
FIG. 8 is a top perspective view of the two-part teethable handle of the infant pacifier.
Figure 3:
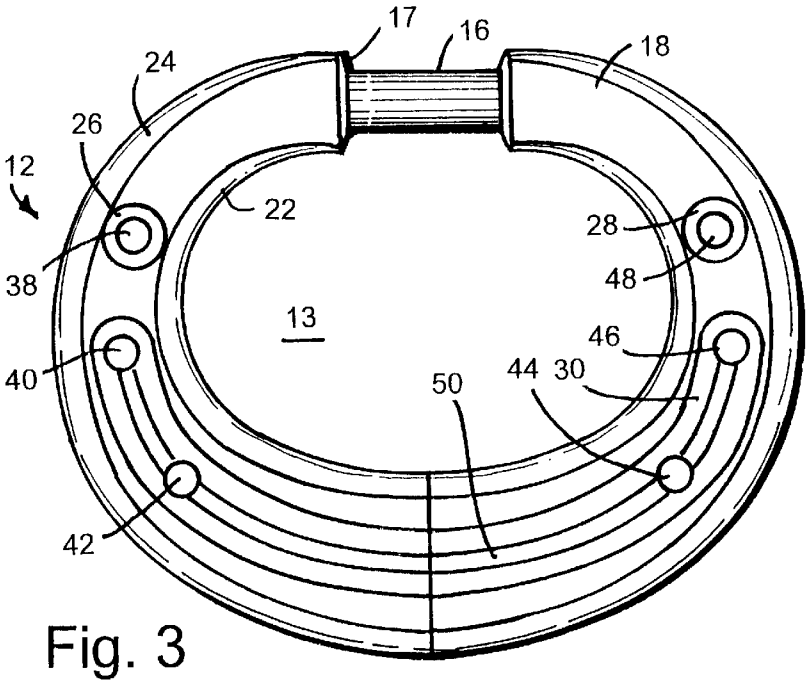
FIG. 3 is a top plan view of the rigid inner handle member.

The illustrated inner handle member 12 (FIG. 2) has a generally annular shape defining an interior space 13 therein. The inner handle member 12 is constructed of a rigid plastic, polypropylene, or similar material. The inner handle member 12, as illustrated, is generally ring-shaped, although it is noted that the inner handle member 12 may be provided in other geometrical shapes. Inner handle member 12 (FIGS. 2–4) is defined by a generally flat top surface 18, a generally flat bottom surface 20, an interior side edge 22, and an exterior side edge 24. Interior side edge 22 and exterior side edge 24 extend between top surface 18 and bottom surface and have a general arcuate shape. Interior side edge 22 is slightly thicker than exterior side edge 24 thereby causing top surface 18 and bottom surface 20 to be slightly tapered towards interior space 13.

Figure 13:
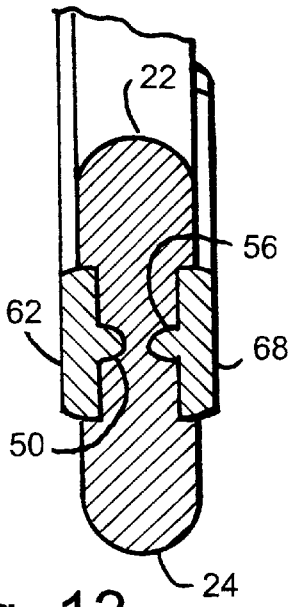
FIG. 13 is an enlarged, fragmentary cross-sectional view of the two-part teethable handle taken of the area XIII, FIG. 12.

Inner handle member 12 is provided with a cylindrically shaped shaft portion 16 extending along one side thereof. Shaft portion 16 is configured so as to allow the pacifier portion 11 (FIG. 1) to be pivotably mounted with handle 12. Top surface 18, bottom surface 20, interior side edge 22, and exterior side edge 24 are blended such that the inner handle member 12 has a generally cylindrical cross-sectional area (FIG. 13) immediately adjacent to the shaft portion 16 thereby defining circularly-shaped ends 17. Top surface 18 and bottom surface 20 vary in width about the circumference of inner handle member 12 such that top surface 18 and bottom surface 20 are at their maximum width at a position juxtaposed from shaft portion 16 across inner handle member 12 and taper to a minimum width at ends 17.

Figure 7:
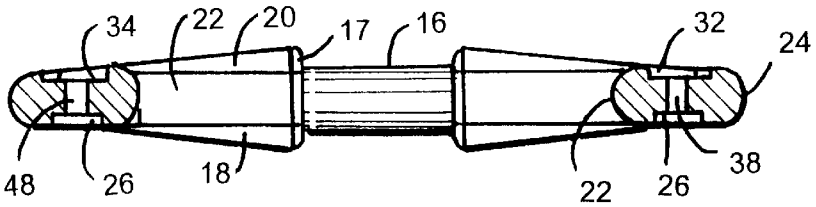
FIG. 7 is a lateral cross-sectional view of the rigid inner handle member taken along the line VII—VII, FIG. 3.
Figure 9:
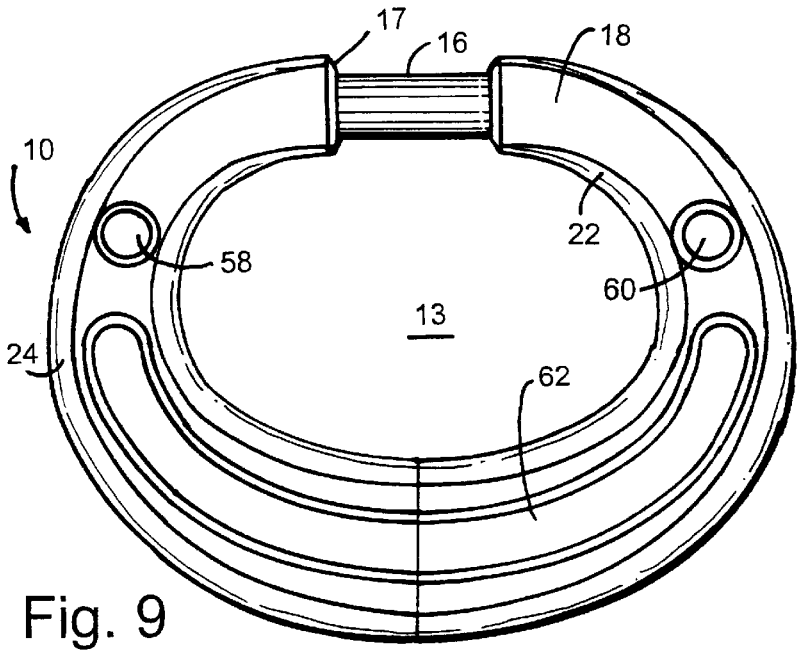
FIG. 9 is a top plan view of the two-part teethable handle.
Figure 10:
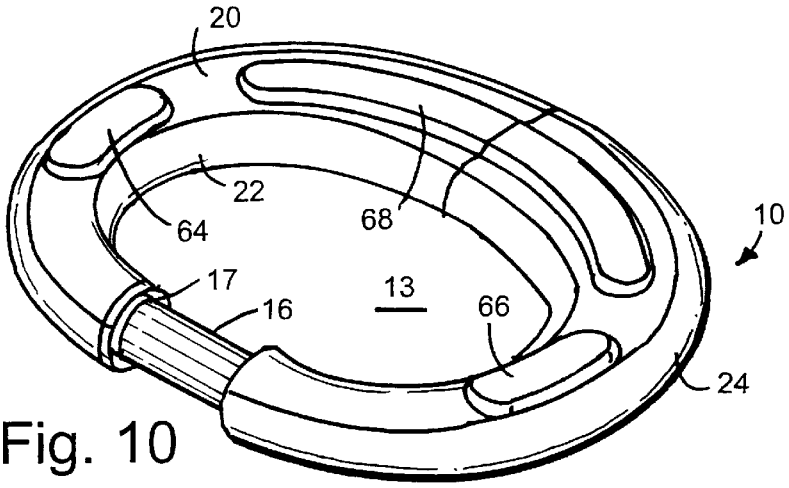
FIG. 10 is a bottom perspective view of the two-part teethable handle.

Inner handle member 12 (FIG. 7) is further provided with a first, second, and third top recess 26, 28, and 30, respectively, inwardly extending into top surface 18, and a first, second, and third bottom recess 32, 34, and 36, respectively, inwardly extending into bottom surface 20. First top recess 26 and second top recess 28, are generally circular in shape. Third top recess 30, first bottom recess 32, second bottom recess 34, and third bottom recess 36 have a generally curved, oval longitudinal cross-sectional shape and follow along the curve defined by top surface 18 and bottom surface 20. Top recesses 26, 28, and 30, and bottom recesses 32, 34, and 36, are centrally located within top surface 18 and bottom surface 20, respectively.

Inner handle member 12 is further provided with a first, second, third, fourth, fifth, and sixth aperture, 38, 40, 42, 44, 46, and 48, respectively, extending between top surface 18 and bottom surface 20 and located at evenly juxtaposed positions about the circumference of handle 12. First aperture 38 and sixth aperture 48 are centrally located within first top recess 26 and second top recess 28, respectively, and centrally located within one end of first bottom recess 32 and second bottom recess 34, respectively. Second aperture 40 and fifth aperture 46 are centrally located within the end of third top recess 30 and centrally located within the ends of first bottom recess 32 and second bottom recess 34, respectively. Third aperture 42 and fourth aperture 44 are centrally located and disposed along the length of third top recess 30 and are centrally located within the ends of third bottom recess 36.

Figure 6:
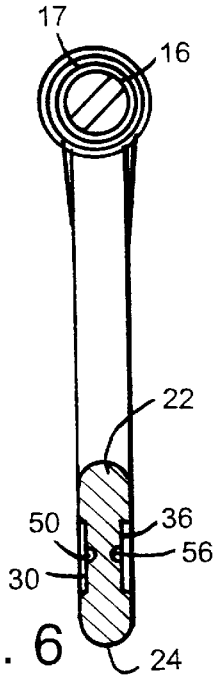
FIG. 6 is a lateral cross-sectional view of the rigid inner handle member taken along the line VI—VI, FIG. 3.

Inner handle member 12 (FIG. 6) is further provided with a top channel 50, a first bottom channel 52, a second bottom channel 54, and a third bottom channel 56. Channels 50, 52, 54, and 56 each have a U-shaped lateral cross-sectional configuration. Top channel 50 is centrally disposed within third top recess 30 and extends between second aperture 40 and fifth aperture 46. First bottom channel 52 is centrally disposed within second bottom recess 34 and extends between fifth aperture 46 and sixth aperture 48. Second bottom channel 54 is centrally disposed within first bottom recess 32 and extends between first aperture 38 and second aperture 40. Third bottom channel 56 is centrally disposed within third bottom recess 36 and extends between third aperture 42 and fourth aperture 44.

Outer handle member 14 is overmolded onto inner handle member 12 such that a mechanical chemical material bond is formed between outer handle member 14 and inner handle member 12, thereby adapting the pacifier handle 10 for teething. Outer handle number 14 is constructed of a material suitable for "chewing" by an infant or toddler such as SYNPRENE®, a modified thermoplastic elastomer manufactured by Synergistics, Inc, or another material displaying similar properties. Outer handle member 14 includes a first top pad 58, a second top pad 60, a third top pad 62, a first bottom pad 64, a second bottom pad 66, and a third bottom pad 68. As illustrated, outer handle member 14 is configured to form pads 58, 60, 62, 64, 66, and 68, although it is noted that outer handle 14 can be configured to cover a greater or lesser amount of inner handle member 12.

Figure 12:
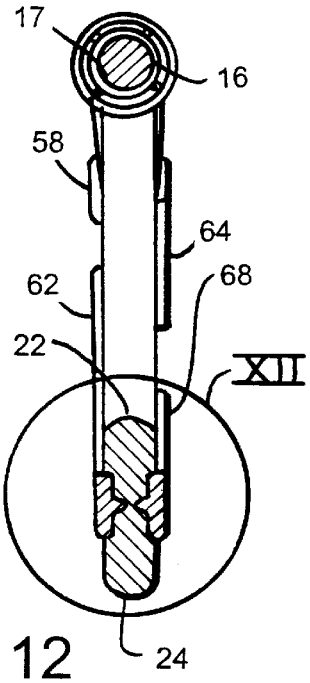
FIG. 12 is a lateral cross-sectional view of the two-part teethable handle taken along the line XII—XII, FIG. 11.
Figure 14:
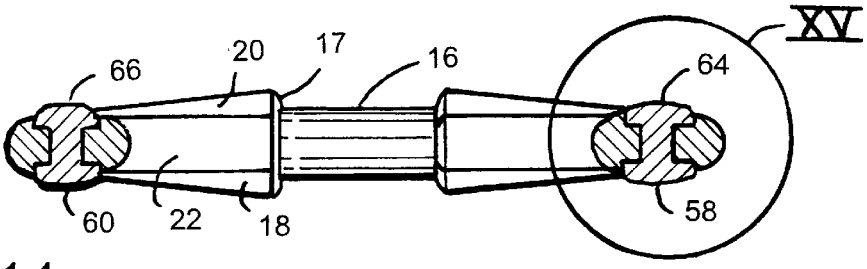
FIG. 14 is a lateral cross-sectional view of the two-part teethable handle taken long the line XIV—XIV, FIG. 11.
Figure 11:
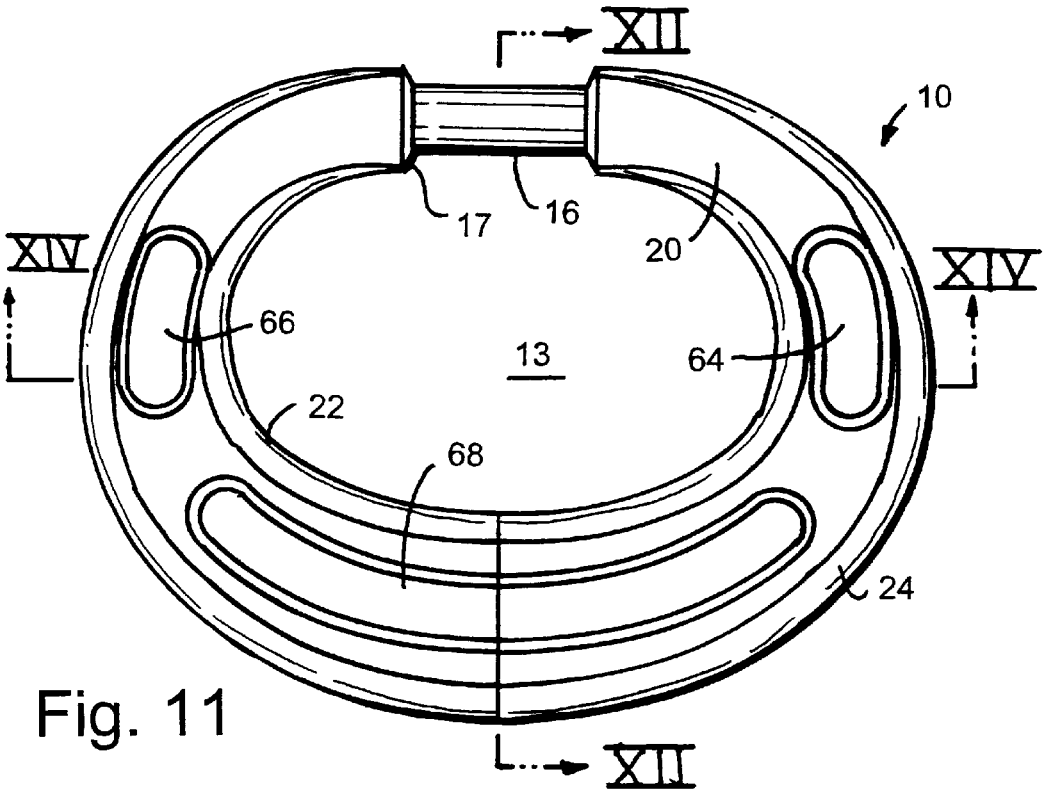
FIG. 11 is a bottom plan view of the two-part teethable handle.
Figure 15:
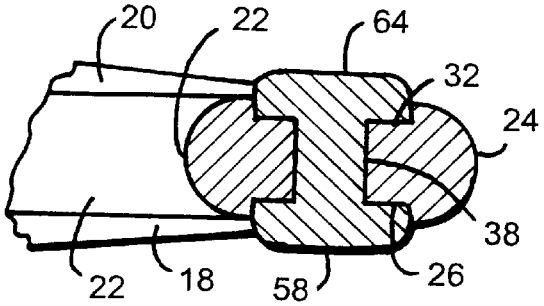
FIG. 15 is an enlarged, fragmentary cross-sectional view of the two-part teethable handle taken of the area XV, FIG. 14.

In the illustrated example, outer handle member 14 has an outwardly extending generally arcuate shape. Outer handle member 14 (FIGS. 8–11) is formed such that each pad 58, 60, 62, 64, 66, and 68 entirely fills each respective recess 26, 28, 30, 32, 34, and 36, and extends into each channel 50, 52, 54, and 56 (FIGS. 12 and 13) associated therewith. Outer handle member 14 (FIGS. 14–15) further extends into and through each aperture 38, 40, 42, 44, 46, and 48, thereby securing outer handle 14 across top surface 18 and bottom surface 20. The configuration of inner handle member 12, increases the durability of handle 10. More specifically, by forming outer handle member 14 within recesses 26, 28, 30, 32, 34 and 36 of inner handle member 12, the edges of outer handle member 14 are contained within recesses 26, 28, 30, 32, 34 and 36, thereby protecting outer handle member 14 from being "peeled" from inner handle member 12. In addition, channels 50, 52, 54 and 56 provide a greater surface area for outer handle member 14 to adhere to during the molding process. Finally, forming outer handle member 14 such that it extends through apertures 38, 40, 42, 44, 46 and 48 connects pads 58, 60 and 62 associated with top surface 18 of inner handle member 12 with pads 64, 66 and 68 associated with bottom surface 20 of inner handle member 12 thereby securing outer handle member 14 about inner handle member 12.

In use, the pacifier portion 11 (FIG. 1) of the infant pacifier 1 may be placed in the mouth of the infant, thereby calming the infant between feedings and/or satisfying the infant's urge to suck. The infant may easily and securely grab the handle 10 of the pacifier 11 because of the shape of the rigid inner handle member 12 and the deformable outer handle member 14. The pivot connection between pacifier portion 11 and handle 10 allows the infant to move his or her hands and arms without altering the relative position of the pacifier portion 11 within the infant's mouth. The infant may also insert the handle 10 into his or her mouth thereby satisfying the infant's urge to teeth or chew. The soft outer handle member 14 renders handle 10 teethable such that the infant may chew handle 10 thereby aiding in the infant's teething process while reducing the pain felt by the infant.

The two-part teethable handle provides the pacifier with extra convenience, particularly for travel and the like, since a separate teether is not needed. The combination of the hard inner handle with soft outwardly projecting pads provides an effective teether, as well as an easy-to-grip handle that can be easily cleaned and sanitized.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a pacifier for infants and the like, the improvement of a two-part teethable handle construction, comprising:

a rigid inner handle member connected with said pacifier, and having an outer surface thereof shaped for grasping;

a soft outer handle member overlying at least a portion of the outer surface of said rigid inner handle member, and being securely connected therewith to define a chewable portion of said handle construction adapted for teething; and wherein said rigid inner handle member has opposed top and bottom surfaces; and said soft outer handle member comprises first and second pads molded over the top and bottom surfaces of said inner handle member.

2. A pacifier as set forth in claim 1, wherein:

said outer surface of said inner handle member is hard relative to said soft outer handle member.

3. A pacifier as set forth in claim 2, wherein:

said top and bottom surfaces of said inner handle member are generally flat; and said pads have generally arcuate outer surfaces, which protrude outwardly from the top and bottom surfaces of said inner handle member.

4. A pacifier as set forth in claim 3, wherein:

said top and bottom surfaces of said inner handle member include recesses in which said outer handle member is molded.

5. A pacifier as set forth in claim 4, wherein:

at least two of said recesses are oppositely disposed on said top and bottom surfaces of said inner handle member, and are interconnected by an aperture extending therebetween through which overmold material flows to integrally interconnect said first and second pads.

6. A pacifier as set forth in claim 5, wherein:

said handle construction has a generally annular shape.

7. A pacifier as set forth in claim 6, wherein:

said outer handle member covers major portions of the top and bottom surfaces of said inner handle member.

8. A pacifier as set forth in claim 7, wherein:

said inner handle member has opposite side surfaces extending between said top and bottom surfaces; and said outer handle member does not cover the opposite side surfaces of said inner handle member.

9. A pacifier as set forth in claim 8, wherein:

said opposite side surfaces of said inner handle member are arcuate.

10. A pacifier as set forth in claim 9, wherein:

said side surfaces of said inner handle member include an interior side edge, and an exterior side edge; and said top and bottom surfaces of said inner handle member are oriented in a non-parallel relationship, such that said interior side edge is thicker than said exterior side edge.

11. A pacifier as set forth in claim 10, wherein:

said inner handle member includes a cylindrical shaft portion pivotally mounting said handle construction to said pacifier.

12. A pacifier as set forth in claim 11, wherein:

said recesses have a U-shaped lateral cross-sectional configuration.

13. A pacifier as set forth in claim 12, wherein:

said top and bottom surfaces of said inner handle member each include three of said pads.

14. A pacifier as set forth in claim 1, wherein:

said inner handle member has opposed, generally flat top and bottom faces with recesses in which said outer handle member is molded.

15. A pacifier as set forth in claim 1, wherein:

said handle construction has a generally annular shape.

16. A pacifier as set forth in claim 1, wherein:

said outer handle member covers only top and bottom portions of said inner handle member.

17. A pacifier as set forth in claim 1, wherein:

said inner handle member includes a cylindrical shaft portion pivotally mounting said handle construction to said pacifier.

18. A method for making a pacifier for infants and the like, comprising:

providing a nipple member shaped for reception in the mouth of a user;

forming a rigid inner handle member with an outer surface thereof in a shape for grasping;

overmolding a soft outer handle member over at least a portion of the outer surface of the rigid inner handle member to securely connect the same therewith and define a two-part handle with a chewable portion adapted for teething;

connecting the two-part handle with the nipple member; and wherein said inner handle forming step comprises forming relatively flat, opposed top and bottom surfaces on the rigid inner handle; and said overmolding step comprises molding first and second pads on the top and bottom surfaces of the inner handle member.

19. A method as set forth in claim 18, wherein:

said overmolding step comprises forming the pads with generally arcuate outer surfaces which protrude outwardly from the top and bottom surfaces of the inner handle member.

20. A method as set forth in claim 19, wherein:

said inner handle forming step includes forming recesses in the top and bottom faces of the inner handle member; and said overmolding step includes molding the first and second pads in the recesses.

21. A method as set forth in claim 20, wherein:

said inner handle forming step comprises forming an aperture between oppositely oriented pairs of recesses; and said overmolding step includes molding material in the aperture substantially contemporaneously with molding in the recesses, such that the pads are integrally interconnected.

22. A pacifier for infants and the like, comprising:

a nipple member shaped for reception in the mouth of a user, and including a laterally extending mounting aperture through a forward portion thereof;

a two-part teethable handle pivotally connected with said nipple member, comprising:

a rigid inner handle member having a generally annular shape, an outer surface thereof shaped for grasping, and a shaft portion pivotally received in said mounting aperture; and a soft outer handle member overlying at least a portion of the outer surface of said rigid inner handle member, and being securely connected therewith to define a chewable portion of said handle construction adapted for teething.

23. A pacifier as set forth in claim 22, wherein:

said outer surface of said inner handle member is hard relative to said soft outer handle member; and said soft outer handle member is molded over the hard outer surface of said inner handle member.

24. A pacifier as set forth in claim 23, wherein:

said inner handle member has opposed top and bottom surfaces with opposite side surfaces extending therebetween; and said soft outer handle member comprises first and second pads molded over the top and bottom surfaces of said inner handle member.

25. A pacifier as set forth in claim 24, wherein:

said opposite side surfaces of said inner handle member are arcuate.

26. A pacifier as set forth in claim 25, wherein:

said side surfaces of said inner handle member include an interior side edge, and an exterior side edge; and said top and bottom surfaces of said inner handle member are oriented in a non-parallel relationship, such that said interior side edge is thicker than said exterior side edge.

27. A pacifier as set forth in claim 22, wherein:

said inner handle member has opposed top and bottom surfaces with opposite side surfaces extending therebetween; and said soft outer handle member comprises first and second pads molded over the top and bottom surfaces of said inner handle member.

28. A pacifier as set forth in claim 22, wherein:

said inner handle member has opposed, generally flat top and bottom surfaces with recesses in which said outer handle member is molded.

29. A pacifier as set forth in claim 22, wherein:

said outer handle member covers only top and bottom portions of said inner handle member.

* * * * *